US007780802B2

(12) United States Patent
Dif et al.

(10) Patent No.: US 7,780,802 B2
(45) Date of Patent: Aug. 24, 2010

(54) SIMPLIFIED METHOD FOR MAKING ROLLED AL—ZN—MG ALLOY PRODUCTS, AND RESULTING PRODUCTS

(75) Inventors: Ronan Dif, Ravenswood, WV (US); Jean-Christophe Ehrstrom, Echirolles (FR); Bernard Grange, Issoire (FR); Vincent Hochenedel, Issoire (FR); Hervé Ribes, Issoire (FR)

(73) Assignee: Alcan Rhenalu, Paris (FR)

( * ) Notice: Subject to any disclaimer, the term of this patent is extended or adjusted under 35 U.S.C. 154(b) by 776 days.

(21) Appl. No.: 10/534,006

(22) PCT Filed: Nov. 6, 2003

(86) PCT No.: PCT/FR03/03312

§ 371 (c)(1),
(2), (4) Date: May 5, 2005

(87) PCT Pub. No.: WO2004/044256

PCT Pub. Date: May 27, 2004

(65) Prior Publication Data

US 2006/0016523 A1 Jan. 26, 2006

(30) Foreign Application Priority Data

Nov. 6, 2002 (FR) ..... 02 13859

(51) Int. Cl.
*C22C 21/10* (2006.01)

(52) U.S. Cl. ..... 148/551

(58) Field of Classification Search ..... 148/551
See application file for complete search history.

(56) References Cited

U.S. PATENT DOCUMENTS

| | | | | |
|---|---|---|---|---|
| 3,694,272 | A | 9/1972 | Fetzer et al | |
| 3,945,861 | A | 3/1976 | Anderson et al. | |
| 4,462,843 | A | 7/1984 | Baba et al. | |
| 4,699,673 | A | 10/1987 | Goto et al. | |
| 4,988,394 | A * | 1/1991 | Cho | 148/693 |
| 5,061,327 | A | 10/1991 | Denzer et al. | |
| 5,874,708 | A * | 2/1999 | Kinsman et al. | 219/121.64 |
| 5,894,879 | A * | 4/1999 | Wyatt-Mair et al. | 164/476 |

(Continued)

FOREIGN PATENT DOCUMENTS

FR 1501662 11/1967

(Continued)

OTHER PUBLICATIONS

NPL: The modeling of stable and metastable phase formation in multi-component A—alloys, in "Aluminum alloy, their physical and mechanical properties, Proc. ICAA9", eds. J.F.Nie et al, (Inst. Materials Engineering Australia, Melbourn, 2004) pp. 96-106.*

(Continued)

*Primary Examiner*—Roy King
*Assistant Examiner*—Jie Yang
(74) *Attorney, Agent, or Firm*—Baker Donelson Bearman Caldwell & Berkowitz PC

(57) ABSTRACT

A process for making Al—Zn—Mg alloy products, and products formed according to such processes are disclosed. The present invention provides a product having an improved compromise between mechanical characteristics and corrosion strength.

15 Claims, 8 Drawing Sheets

U.S. PATENT DOCUMENTS 6,302,973 B1 10/2001 Haszler et al.

FOREIGN PATENT DOCUMENTS

| | | |
|---|---|---|
| GB | 1419491 | 12/1975 |
| JP | 6-503854 | 4/1994 |
| JP | 09-268342 | 10/1997 |
| JP | 11-006044 | 1/1999 |
| JP | 11-302763 | 11/1999 |
| WO | WO-92/03586 | 3/1992 |

OTHER PUBLICATIONS

Pechiney Aluminum, "Demi produits aluminum; Caractéristiques générales—Aluminum mill products; general properties" Oct. 1985, Paris, France, XP-002240985.

Klyszewski et al "Structure and properties of AlZnMg1 alloy" 1977, Chemical Abstracts Service, Columbus Ohio, XP-002240986.

Styczynska, et al "Grain boundries as dislocation sources in a material with precipitate-free zones" 1985, XP-002240987.

"New weldable A1ZnMg alloys" by B.J. Young, which appeared in Light Metals Industry, Nov. 1963.

"Rules for classification of Ships—Newbuildings—Materials and Welding—Part 2 Chapter 3: Welding" of Jan. 1996.

J. Marthinussen, S. Grjotheim, "Qualification of new aluminium alloys", 3rd International Forum on Aluminium Ships, Haugesund, Norway, May 1998.

"Strain Corrosion in A1-5Zn-1.2Mg crystals in a NaC1 30 g/1 environment" by T. Magnin and C. Dubessy, which appeared in the Memoires et Etudes Scientifiques Revue de Metallurgie, Oct. 1985, pp. 559-567.

"The stress corrosion susceptibility of aluminium alloy 7020 welded sheets" by M.C. Reboul, B. Dubost and M. Lashermes, which appeared in the review Corrosion Science, vol. 25, No. 11, pp. 999-1018, 1985.

* cited by examiner

SIMPLIFIED METHOD FOR MAKING ROLLED AL—ZN—MG ALLOY PRODUCTS, AND RESULTING PRODUCTS

CROSS REFERENCE TO RELATED APPLICATIONS

This application is a §371 national stage application of International Application No. PCT/FR03/003312 filed Nov. 6, 2003 which claims priority to French Application No. 02/13859 filed Nov. 6, 2003.

BACKGROUND OF THE INVENTION

1. Technical Field of the Invention

The present invention relates to alloys of the Al—Zn—Mg type with good mechanical strength, and more particularly alloys intended for welded constructions such as the structures employed in the field of shipbuilding, motor vehicle bodywork, industrial vehicles and fixed or mobile tanks.

2. Prior Art Description of Related Art

To manufacture welded structures, aluminium alloys of the 5xxx series (5056, 5083, 5383, 5086, 5186, 5182, 5054 etc.) and 6xxx series (6082, 6005A etc.) are generally used. 7xxx alloys with a low copper content, that are weldable (such as 7020, 7108 etc.), are also adapted for making welded parts in so far as they have very good mechanical properties, even after welding. These alloys are however subject to problems of layer corrosion (in the T4 state and in the weld affected zone) and stress corrosion (in the T6 state).

Alloys of the 5xxx group (Al—Mg) are usually used in the H1x (strain-hardened), H2x (strain-hardened then restored), H3x (strain-hardened and stabilised) or O (annealed) states. The choice of temper depends on the compromise between mechanical strength, corrosion strength and formability that is targeted for a given use.

7xxx alloys (Al—Zn—Mg) are known as having "structural hardening", which means that they acquire their mechanical properties through precipitation of the alloying elements (Zn, Mg). The man skilled in the art knows that, to obtain these mechanical properties, hot transformation by rolling or extrusion is followed by solution treatment, quenching or an ageing treatment. The purpose of these operations, which are carried out in most cases separately, is respectively to dissolve the alloying elements, to keep them in a supersaturated solid solution form at ambient temperature, and lastly to precipitate them in a controlled manner.

Alloys of the 6xxx (Al—Mg—Si) and 7xxx (Al—Zn—Mg) groups are usually used in the age treated state. In the case of products in the form of sheets or strips, the ageing treatment giving the greatest mechanical strength is denoted T6, when forming by rolling or extrusion is followed by a separate solution treatment and quenching.

When dimensioning a structure, the parameters governing user choice are essentially the static mechanical characteristics, in other words, the fracture strength $R_m$, the yield strength $R_{p0.2}$, and the elongation at fracture A. Other parameters coming into play, depending on the specific needs of the targeted application, are the mechanical characteristics of the welded joint, the corrosion (layer and stress) strength of the sheet and welded joint, the fatigue strength of the sheet and welded joint, the crack propagation strength, the fracture toughness, the dimensional stability after cutting or welding, and resistance to abrasion. For each targeted use, an adapted compromise needs to be found between these different properties.

The possibility of producing laminated products of constant quality on an industrial basis with a manufacturing process that is as straightforward as possible and a production cost as low as possible is also an important factor in the choice of material.

For 7xxx alloys (Al—Zn—Mg), the prior art offers a number of ways to improve the compromise of properties.

The patent GB 1 419 491 (British Aluminium) discloses a weldable alloy containing 3.5-5.5% zinc, 0.7-3.0% magnesium, 0.05-0.30% zirconium, optionally up to 0.05% each of chrome and manganese, up to 0.10% iron, up to 0.075% silicon, and up to 0.25% copper.

The article "New weldable AlZnMg alloys" by B. J. Young, which appeared in Light Metals Industry, November 1963, mentions two compound alloys:

Zn 5.0% Mg 1.25% Mn 0.5% Cr 0.15% Cu 0.4% and

Zn 4.5% Mg 1.2% Mn 0.3% Cr 0.2%.

The article mentions the use of this type of alloy for lorry skips and in shipbuilding.

The patent FR 1 501 662 (Vereinigte Aluminium-Werke Aktiengesellschaft) describes a weldable compound alloy Zn 5.78% Mg 1.62% Mn 0.24% Cr 0.13% Cu 0.02% Zr 0.17% used in the form of 4 mm thick sheets, after solution treatment for an hour at 480° C., quenching in water and a two stage ageing treatment (24 hours at 120° C., then 2 hours at 180° C.), to manufacture armour plating.

The patent U.S. Pat. No. 5,061,327 (Aluminum Company of America) describes a process of manufacturing a laminated product in an aluminium alloy comprising the casting of a plate, homogenising, hot rolling, reheating the stock to a temperature between 260° C. and 582° C., fast-cooling it, a precipitation treatment at a temperature between 93° C. and 288° C., then cold or hot rolling at a temperature not exceeding 288° C.

The problem to which the present invention tries to respond is first of all to improve the compromise of certain properties of Al—Zn—Mg alloys in the form of sheets or strips, namely the compromise between the mechanical characteristics (determined on the base metal and on the welded joint), and the corrosion strength (layer corrosion and stress corrosion). Furthermore, the aim is to make these products using a production process that is as straightforward and reliable as possible, allowing them to be manufactured with a manufacturing cost that is as low as possible.

SUMMARY OF THE INVENTION

The first subject of the present invention is a process for generating an intermediate laminated product in an aluminium alloy of the Al—Zn—Mg type, including the following steps:

a) by semi-continuous casting a plate is generated containing (in percentages per unit mass)

Mg 0.5-2.0 Mn<1.0 Zn 3.0-9.0

Si<0.50 Fe<0.50 Cu<0.50 Ti<0.15

Zr<0.20 Cr<0.50 the remainder aluminium with its inevitable impurities, in which Zn/Mg>1.7;

b) said plate is subjected to homogenisation and/or reheating to a temperature $T_1$, selected so that $500° C. \leqq T_1 \leqq (T_S - 20° C.)$, where $T_S$ is the alloy burning temperature, c) an initial hot-rolling step is carried out including one or more roll runs on a hot rolling mill, the input temperature $T_2$ being selected such that $(T_1 - 60° C.) \leqq T_2 \leqq (T_1 - 5° C.)$, and the rolling process being adapted in such a way that the output temperature $T_3$ is such that $(T_1-150° C.) \leqq T_3 \leqq (T_1-30° C.)$ and $T_3 \leqq T_2$;

d) the strip emerging from said initial hot-rolling step is cooled by an appropriate means to a temperature $T_4$;

e) a second hot-rolling step is carried out on said strip on a tandem mill, the input temperature $T_5$ being selected such that $T_5 \leqq T_4$ and $200° C. \leqq T_5 \leqq 300° C.$, and the rolling process being conducted in such a way that the coiling temperature $T_6$ is such that $(T_5-150° C.) \leqq T_6 \leqq (T_5-20° C.)$.

A second subject is a product which can be obtained by the process according to the invention, possibly after additional steps of cold working and/or heat treatment, which shows a yield strength $R_{p0.2}$ of at least 250 MPa, a fracture strength $R_m$ of at least 280 MPa, and an elongation at fracture of at least 8%. Preferably, $R_{p0.2}$ is at least 290 MPa and $R_m$ at least 330 MPa.

A third subject is the use of the product which can be obtained through the process according to the invention to manufacture welded constructions.

Another subject is the welded construction made with at least two products which can be obtained through the process according to the invention, characterised in that its yield strength $R_{p0.2}$ in the welded joint between two of said products is at least 200 MPa.

BRIEF DESCRIPTION OF THE DRAWINGS

(1) Initial hot-rolling step (2) Cooling (3) Second hot-rolling step (4) Coiling and on-coil cooling

DETAILED DESCRIPTION OF PREFERRED EMBODIMENT

Figure 1:
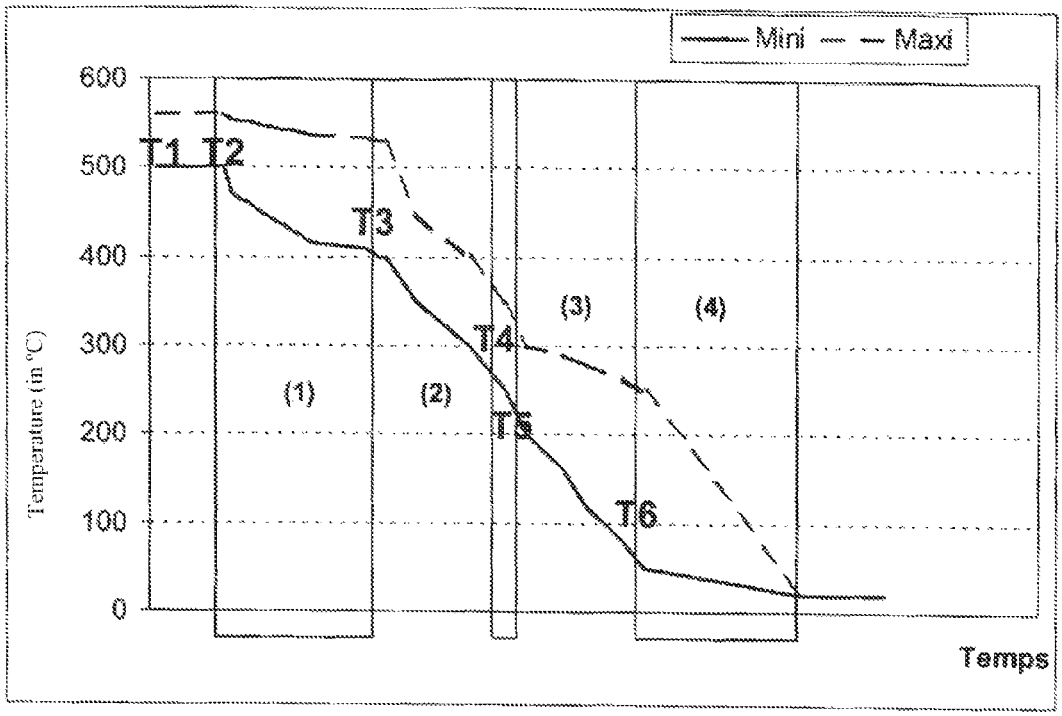
FIG. 1 gives a typical production process in a time-temperature diagram. The reference numbers correspond to the different steps in the process.

Unless otherwise indicated, all indications relating to the chemical composition of alloys are expressed in percentages per unit mass. Consequently, in a mathematical expression, "0.4 Zn" signifies: 0.4 times the zinc content, expressed as a percentage per unit mass; this applies allowing for a few minor variations to the other chemical elements. The alloys are designated in accordance with the rules of The Aluminum Association, known to the man skilled in the art. The tempers are defined in European standard EN 515. The chemical composition of standardised aluminium alloys is defined for example in the standard EN 573-3. Unless otherwise indicated, the static mechanical characteristics, in other words the fracture strength $R_m$, the yield strength $R_{p0.2}$, and the elongation at fracture A, of the metal sheets are determined by a tensile test in accordance with EN standard 10002-1, the place and direction of taking the samples being defined by the standard EN 485-1.

The crack propagation rate da/dn is determined in accordance with ASTM standard E647, damage tolerance $K_R$ in accordance with ASTM standard E561, resistance to exfoliation corrosion (also known as laminating corrosion) is determined according to ASTM standard G34 (Exco test) or ASTM G85-A3 (Swaat test); for these tests, and for even more specialised tests, additional information is given below in the description and in the examples.

The applicant has found surprisingly that laminated products can be manufactured in a 7xxx alloy which show a very good compromise of properties, particularly in the welded state, using a simplified process, in which the solution treatment, the quenching and the ageing treatment are carried out during the hot transformation by rolling.

The process according to the invention can be implemented on Al—Zn—Mg alloys in a wider range of chemical composition: Zn 3.0-9.0%, Mg 0.5-2.0%, the alloy also being able to contain Mn<1.0%, Si<0.50%, Fe<0.50%, Cu<0.50%, Cr<0.50%, Ti<0.15%, Zr<0.20%, as well as the inevitable impurities.

The magnesium content must be between 0.5 and 2.0% and preferably between 0.7 and 1.5%. Below 0.5%, mechanical properties are obtained which are not satisfactory for many applications, and above 2.0%, a deterioration can be noted in the corrosion strength of the alloy. Furthermore, above 2.0% of magnesium, the quenchability of the alloy is no longer satisfactory, which damages the efficiency of the process according to the invention.

The manganese content must be below 1.0% and preferably below 0.60%, so as to restrict sensitivity to layer corrosion and to retain good quenchability. A content not exceeding 0.20% is preferred.

The zinc content must be between 3.0 and 9.0%, and preferably between 4.0 and 6.0%. Below 3.0%, the mechanical characteristics are too weak to be of any technical interest, and above 9.0%, a deterioration can be observed in the corrosion strength of the alloy, as well as a deterioration in quenchability.

The Zn/Mg ratio must be above 1.7 in order to make it possible to stay in the field of composition that benefits from structural hardening.

The silicon content must be below 0.50% in order not to degrade the corrosion behaviour or the tear strength. For these same reasons, the iron content must also be below 0.50%.

The copper content must be below 0.50% and preferably below 0.25%, which allows sensitivity to pitting corrosion to be restricted and good quenchability to be retained. The chrome content must be below 0.50%, which allows sensitivity to layer corrosion to be restricted and good quenchability to be retained. The titanium content must be below 0.15% and the zirconium content below 0.20%, in order to prevent harmful primary phases from forming; for Zr, it is preferable not to exceed 0.15%.

Adding one or more elements selected from the group formed by Sc, Y, La, Dy, Ho, Er, Tm, Lu, Hf, Yb is advantageous; their concentration should not exceed the following values:

Sc<0.50% and preferably <0.20%
Y<0.34% and preferably <0.17%
La<0.10% and preferably <0.05%
Dy<0.10% and preferably <0.05%
Ho<0.10% and preferably <0.05%
Er<0.10% and preferably <0.05%
Tm<0.10% and preferably <0.05%
Lu<0.10% and preferably <0.05%
Hf<1.20% and preferably <0.50%
Yb<0.50% and preferably <0.25%

By "quenchability" is understood here the capacity of an alloy to be quenched within a fairly wide range of quenching rates. A so-called easily quenchable alloy is therefore an alloy for which the cooling rate during quenching does not have a major impact on the properties of use (such as the mechanical strength or corrosion strength).

The process according to the invention comprises the following steps:

(a) The casting of a rolling plate in an aluminium alloy according to one of the known methods, said alloy having the composition given above;

(b) The homogenisation and/or the reheating of this rolling plate to a temperature $T_1$ between 500° C. and ($T_S$−20° C.), where $T_S$ represents the alloy burning temperature, for a sufficient length of time to homogenise the alloy and to bring it to a suitable temperature for the remainder of the process;

(c) An initial step of hot-rolling said plate typically using a reversing mill, at an input temperature $T_2$ such that ($T_1$−60° C.)≦$T_2$≦($T_1$−5° C.), and the rolling process being conducted in such a way that the output temperature $T_3$ is such that ($T_1$−150° C.)≦$T_3$≦($T_1$−30° C.) and $T_3$≦$T_2$.

(d) The cooling of the strip emanating from said initial rolling step by an appropriate means to a temperature $T_4$;

(e) A second step of hot-rolling said strip typically using a tandem mill, the input temperature $T_5$ being selected such that $T_5$≦$T_4$ and 200° C.≦$T_5$<300° C., and the rolling process being conducted in such a way that the coiling temperature $T_6$ is such that ($T_5$−150° C.)≦$T_6$≦($T_5$−20° C.).

The burning temperature $T_S$ is a quantity known to the man skilled in the art, who determines it for example directly by calorimetry on an unwrought casting sample, or again by thermodynamic calculation taking into consideration the phase diagrams. The temperatures $T_2$ and $T_5$ correspond to the surface temperature (most often the upper surface) of the plate or strip measured just before its entry to the hot mill; execution of this measurement can be done according to methods known to the man skilled in the art.

In an advantageous embodiment the temperature $T_3$ is selected such that ($T_1$−100° C.)≦$T_3$≦($T_1$−30° C.). In another advantageous embodiment, $T_2$ is selected such that ($T_1$−30° C.)≦$T_2$≦($T_1$−5° C.). In yet another advantageous embodiment, $T_6$ is selected such that ($T_5$−150° C.)≦$T_6$≦($T_5$−50° C.).

It is preferable to select the temperature $T_3$ such that it is greater than the solvus temperature of the alloy. The solvus temperature is determined by the man skilled in the art using differential calorimetry. Maintaining T3 above the solvus temperature allows the gross precipitation of the phases of $MgZn_2$ type to be minimised. It is preferred that these phases are formed in a controlled manner in the form of fines precipitated during coiling or after coiling.

Control of the temperature $T_3$ is thus particularly critical. The temperature $T_4$ is likewise a critical parameter of the process.

Between steps b) and c), c) and d), and d) and e), the temperature must not drop below the specified value. In particular, it is desirable for the temperature at input into the hot mill during step (e), which is performed advantageously on a tandem mill, to be substantially equal to the temperature of the strip after cooling, which requires either a sufficiently rapid transfer of the strip from one rolling mill to another, or, in a preferred way, an on-line process. In a preferred embodiment of the process according to the invention, steps b), c), d) and e) are carried out on-line, in other words an element of volume of a given metal (in the form of a rolling plate or a laminated strip) passes from one step to the other without intermediate storage likely to lead to an uncontrolled drop in its temperature which would necessitate an intermediate reheating. Indeed, the process according to the invention is based on a precise change in the temperature during steps b), c), d) and e); FIG. 1 shows one embodiment of the invention.

The cooling at step (d) can be done by any means ensuring sufficiently rapid cooling, such as immersion, spraying, forced convection, or a combination of these means. By way of example, passing the strip through a spray-quenching cell, followed by passing through a natural or forced convection quenching caisson, followed by passing through a second spray-quenching cell gives good results. However, cooling by natural convection as sole means is not fast enough, whether in strip or coil. In general terms, at this stage of the process cooling by coil does not produce satisfactory results.

After coiling (step e), the coil may be left to cool. The product emanating from step (e) may be subjected to further operations such as cold-rolling, ageing treatment, or cutting. In one advantageous embodiment of the invention, the intermediate laminated product according to the invention is subjected to cold working between 1% and 9%, and/or to an additional heat treatment including one or more points at temperatures between 80° C. and 250° C., said additional heat treatment being able to occur before, after or during said cold working.

The process according to the invention is designed so as to be able to carry out on line three heat treatment operations which are usually carried out separately: solution treatment (carried out according to the invention during the initial hot-rolling step), quenching (carried out according to the invention when cooling the strip), ageing treatment (carried out according to the invention when cooling the coil). More particularly, the process according to the invention may be conducted in such a way that it is not necessary to reheat the product once it has passed into the hot reversing mill, each step of said process being at a lower temperature than the previous one. This allows energy to be saved. The intermediate laminated product obtained by the process according to the invention can be used as it is, in other words without subjecting it to other process steps which alter its temper; that is preferable. If necessary, it may be subjected to other process steps that alter its temper, such as cold rolling.

Compared with a process that carries out these three steps separately, the process according to the invention may sometimes lead, for a given alloy, to static mechanical characteristics that are slightly less good. On the other hand, in a number of cases, it leads to an improvement in damage tolerance, as well as to an improvement in corrosion strength, especially after welding. This has been observed particularly for a restricted range of composition, as will be explained below. The compromise of properties which is obtained with the process according to the invention is at least as advantageous as that which is obtained by a conventional manufacturing process, in which the solution treatment, quenching and ageing treatment are carried out separately and which leads to the T6 state. On the other hand, the process according to the invention is much more straightforward and less expensive than known processes. It leads advantageously to an intermediate product with a thickness between 3 mm and 12 mm; above 12 mm, coiling becomes technically difficult, and below 3 mm, apart from the technical difficulties of hot-rolling at this thickness zone, the strip may well cool down too much.

As will be explained below, a preferred composition range for implementing the process according to the invention is characterised by Zn 4.0-6.0, Mg 0.7-1.5, Mn<0.60, and preferably Cu<0.25. Alloys exhibiting good quenching capacity are preferred and of these alloys the alloys 7020, 7003, 7004, 7005, 7008, 7011, 7018, 7022 and 7108 are preferred.

A particularly advantageous implementation of the process according to the invention is on a 7108 alloy with: $T_1$=550° C., $T_2$=540° C., $T_3$=490° C., $T_4$=270° C., $T_5$=270° C., $T_6$=150° C.

Products in Al—Zn—Mg alloys according to the invention can be welded using any known welding process, such as MIG or TIG welding, friction welding, laser welding, electron beam welding. Welding tests have been carried out on sheets with a double Vee groove, welded by semi-automatic smooth current MIG welding, with a 5183 alloy welding wire. Welding was carried out in the direction perpendicular to the rolling. Mechanical tests on the welded test pieces were carried out in accordance with a method recommended by the company Det Norske Veritas (DNV) in their document "Rules for classification of Ships—Newbuildings—Materials and Welding—Part 2 Chapter 3: Welding" of January 1996. In this method, the width of the tensile test piece is 25 mm, the bead is shaved symmetrically and the effective length of the test piece and the length of the extensometer used is given as (W+2.e) where the parameter W denotes the width of the bead and the parameter e denotes the thickness of the test piece.

More particularly, the applicant has observed that the MIG welding of products according to the invention leads to welded joints characterised by a greater yield strength and fracture strength than with an alloy manufactured with a conventional production process (T6). This result, which expresses a clear advantage for mechanically welded constructions, in other words constructions in which the welded zone fulfils a structural function, is surprising in so far as the static properties of the non-welded metal are rather weaker than in the T6 state.

The corrosion strength of the base metal and of the welded joints has been assessed using SWAAT and EXCO tests. The SWAAT test allows the corrosion (particularly layer corrosion) strength of aluminium alloys to be assessed in a general way. Since the process according to the present invention leads to a product with a strongly fibrous structure, it is important to ensure that said product resists exfoliating corrosion, which forms mainly on products exhibiting a fibrous structure. The SWAAT assay is described in appendix A3 to ASTM standard G85. It is a cyclical test. Each cycle, of two hours duration, consists of a 90 minute moistening phase (98% relative humidity) and thirty minutes spraying time, with a solution composed (for one liter) of salt for artificial seawater (see Table 1 for the composition, which complies with ASTM standard D1141) and 10 ml glacial acetic acid. The pH of this solution is between 2.8 and 3.0. The temperature throughout one cycle is between 48° C. and 50° C. In this test, the test pieces for testing are inclined by 15° to 30° relative to the vertical. The test was carried out over 100 cycles.

TABLE 1

| | salt composition for artificial seawater | | | | | | | | | |
|---|---|---|---|---|---|---|---|---|---|---|
| | NaCl | $MgCl_2$ | $Na_2SO_4$ | $CaCl_2$ | KCl | $NaHCO_3$ | KBr | $H_3BO_3$ | $SrCl_2$ | NaF |
| g/l | 24.53 | 5.20 | 4.09 | 1.16 | 0.69 | 0.20 | 0.10 | 0.027 | 0.025 | 0.003 |

The EXCO test, of 96 hours duration, is described in ASTM standard G34. It is mainly intended to establish the layer corrosion strength of aluminium alloys containing copper, but may also be suitable for Al—Zn—Mg alloys (see J. Marthinussen, S. Grjotheim, "Qualification of new aluminium alloys", 3rd International Forum on Aluminium Ships, Haugesund, Norway, May 1998).

Figure 2:
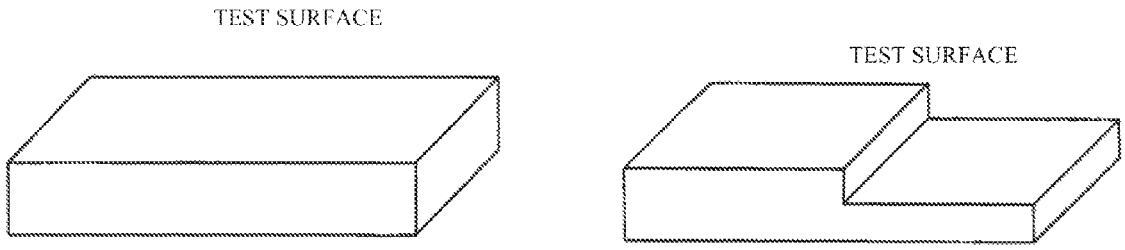
FIG. 2 shows the test pieces used for layer corrosion testing.
Figure 3:
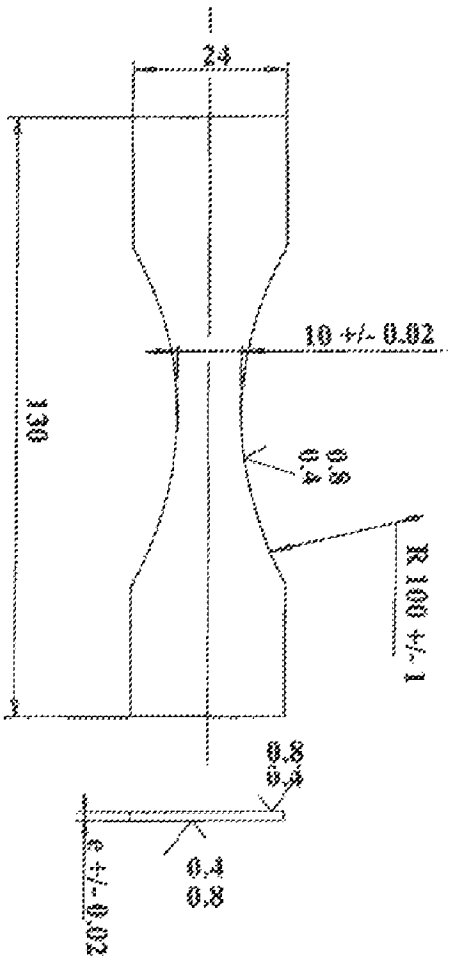
FIG. 3 shows the test pieces used for stress corrosion testing. The readings are given in millimetres.

For these two test types, rectangular test pieces were used, with one surface being protected by an adhesive aluminium strip (so as to engage only the other surface) and with the surface to be engaged being either left as it was, or machined to half-thickness over half the surface of the sample, and left full thickness over the other half. The diagrams of the test pieces used for each of the tests are given in FIGS. 2 (layer corrosion) and 3 (stress corrosion).

The applicant has observed that the product according to the invention had a layer corrosion strength equivalent to that which is obtained for the standard product (identical or close alloy in the T6 state).

A particularly preferred product according to the present invention contains between 4.0 and 6.0% zinc, between 0.7 and 1.5% magnesium, less than 0.60% and still more preferably less than 0.20% manganese, and less than 0.25% copper. Such a product shows a weight loss of less than 1 g/dm$^2$ during the SWAAT test (100 cycles), and of less than 5.5 g/dm$^2$ during the EXCO test (96 h), prior to ageing treatment or after an eaging treatment corresponding at most to 15 h at 140° C.

Figure 4:
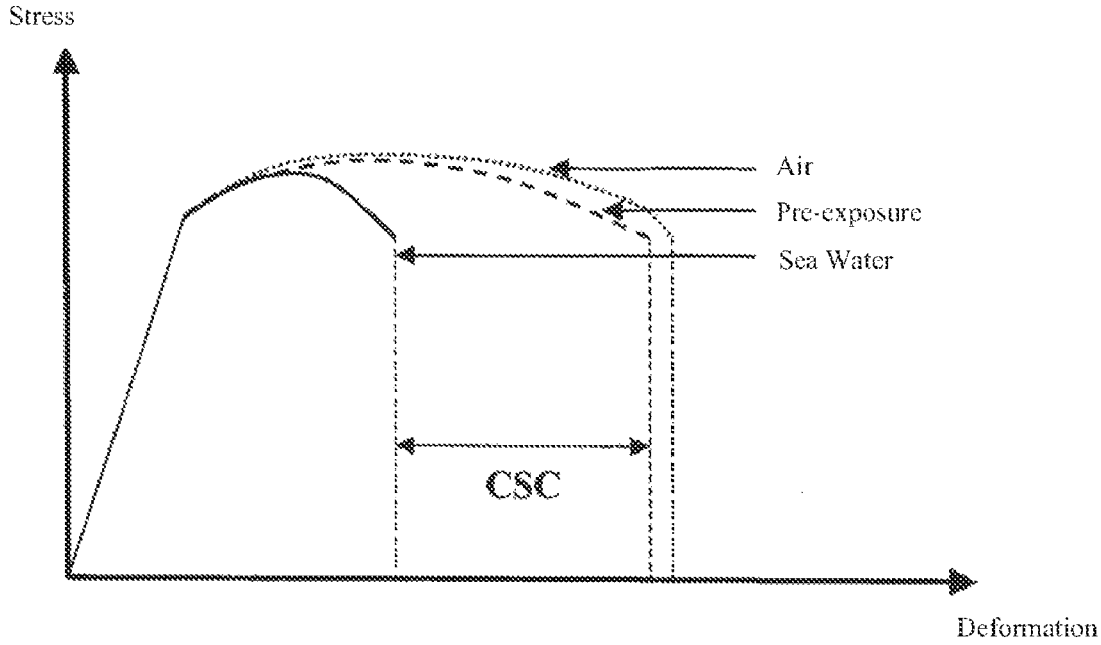
FIG. 4 gives the principle of slow strain rate testing (stress corrosion).

The stress corrosion strength was characterised using slow strain rate testing, described for example in ASTM standard G129. This test is faster and more discriminating than methods consisting in determining the no fracture threshold stress in stress corrosion. The principle of slow rate strain testing, put in diagrammatic form in FIG. 4, consists in comparing tensile properties in an inert environment (laboratory air) and in an aggressive environment. The drop in static mechanical properties in a corrosive environment corresponds to the sensitivity to stress corrosion. The most sensitive characteristics of tensile testing are elongation at fracture A and the maximum strain (at necking) $R_m$. Elongation at fracture was used, since it is a much more discriminating quantity than the maximum strain. It is however necessary to ensure that the reduction in static mechanical characteristics does in fact equate to stress corrosion, which is defined as the synergic and simultaneous action of the mechanical solicitation and the environment. The suggestion has therefore been made that tensile tests should also be performed in an inert environment (laboratory air), after a prior, unstressed, pre-exposure of the test piece in the aggressive environment, for the same length of time as the tensile test performed in this environment. Sensitivity to stress corrosion is then defined using an index I defined as:

$$I = \frac{A\%_{Pre-expo} - A\%_{AggressiveEnvironment}}{A\%_{InertEnvironment}}$$

The critical aspects of slow strain rate testing relate to the choice of tensile test piece, the deformation rate and the corrosive solution. A test piece in a cut-out shape with a radius of curvature of 100 mm, allowing the deformation to be pinpointed and the test to be even more stringent, was used. It was taken in the Longitudinal or Transverse-Long direction. As far as the solicitation rate is concerned, it is acknowledged, particularly on Al—Zn—Mg alloys (see the article "Strain Corrosion in Al-5Zn-1.2Mg crystals in a NaCl 30 g/l environment" by T. Magnin and C. Dubessy, which appeared in the Mémoires et Etudes Scíentifiques Revue de Métallurgie, October 1985, pages 559-567), that too fast a rate does not allow stress corrosion phenomena to develop, but that too slow a rate masks stress corrosion. In a preliminary test, the applicant determined the deformation rate of $5.10^{-7}$ $s^{-1}$ (corresponding to a cross-head displacement rate of $4.5.10^{-4}$ mm/min), which allows the effects of stress corrosion to be maximised; it was this rate which was then selected for the test. In relation to which aggressive environment to use, the same type of problem is posed in so far as too aggressive an environment masks stress corrosion, but where too mild an environment does not allow the corrosion phenomenon to be brought out. In order to get as close as possible to actual conditions of use, but also to maximise the effects of stress corrosion, a solution of synthetic seawater was used for this test (see ASTM specification D1141, the composition of which is given in Table 1). For each case, three test pieces at least were tested.

The applicant has found that the process according to the invention makes it possible to obtain products which, for a limited range of composition relative to the range of composition in which the process according to the invention can be implemented, namely Zn 4.0-6.0%, Mg 0.7-1.5%, Mn<0.60%, and Cu<0.25%, have new micro-structural characteristics. These micro-structural characteristics lead to particularly advantageous properties of use, and particularly to better corrosion strength.

In these products according to the invention the width of the precipitation-free zone (PFZ) at the grain boundaries is more than 100 nm, preferably between 100 and 150 nm, and even more preferably from 120 to 140 nm; this width is much greater than that of comparable prior art products (in other words having the same composition, the same thickness and obtained according to a standard T6 process), for which this value does not exceed 60 nm. It may also be observed that $MgZn_2$ type precipitations at the grain boundaries have an average size of more than 150 nm, and preferably between 200 and 400 nm, whereas this size does not exceed 80 nm in prior art products. Furthermore, hardening precipitations of the $MgZn_2$ type are much coarser in a product according to the invention than in a comparable prior art product. This indicates that in the process according to the present invention, the quenching is not as rapid as in a classic process with solution treatment in a furnace followed by separate quenching. It is clear that the process according to the invention does not prevent certain precipitation of coarse phases from the temperature $T_4$. However, while the process according to the present invention is being carried out it should be ensured that the quenching rate is sufficiently high, and that precipitation at a temperature as low as possible is obtained. Said phases must not massively precipitate at a temperature of between $T_4$ and $T_5$.

These quantitative micro-structural analyses were carried out by transmission electron microscopy with an acceleration voltage of 120 kV on samples taken at half-thickness in the L-TL direction and thinned electrolytically by twin jet in a mix of 30% $HNO_3$+methanol at −35° C. at a voltage of 20 V.

It may also be observed that the product obtained by the process according to the invention has a fibred granular structure, in other words grains with a thickness or a thickness/length ratio that is much smaller than for prior art products. By way of example, for a product according to the invention, the grains have a size in the (transverse-short) direction of thickness of less than 30 μm, preferably less than 15 μm and even more preferably less than 10 μm, and a thickness/length ratio of more than 60, and preferably of more than 100, whereas for a comparable prior art product, the grains have a size in the (transverse-short) direction of thickness of more than 60 μm and a thickness/length ratio clearly below 40.

The sheets and strips emanating from the process according to the present invention, and particularly those based on the limited range of composition defined by Zn 4.0-6.0%, Mg 0.7-1.5%, Mn<0.60%, and preferably Cu<0.25%, can to advantage be used for the construction of motor vehicle parts, industrial vehicles, road or rail tankers, and for construction in the naval environment.

All the sheets and strips emanating from the process according to the present invention lend themselves particularly well to welded construction; they can be welded by all the known welding processes which are appropriate for this type of alloy. The sheets can be welded to each other according to the invention, or with other aluminium or aluminium alloy sheets, using an appropriate welding wire. By welding two or more sheets according to the invention, it is possible to obtain constructions that have, after welding, a yield strength (measured as described above) of at least 200 MPa. In a preferred embodiment, this value is at least 220 MPa. The fracture strength of the welded joint is at least 250 MPa, and in a preferred embodiment at least 280 MPa, and preferably at least 300 MPa, measured after at least one month of ageing. In a preferred embodiment a heat-affected zone is obtained which shows a hardness of at least 100 HV, preferably at least 110 HV, and even more preferably of at least 115 HV; this hardness is at least as great as that of base sheets, which has the lowest level of hardness.

Surprisingly, the applicant has observed that the product obtained from the process according to the present invention, in the domain of preferential composition (Zn 4.0-6.0%, Mg 0.7-1.5%, Mn<0.60%), exhibits greater resistance to sand abrasion than comparable products. The applicant observes that this resistance to abrasion does not depend simply on the mechanical characteristics of the product, nor on its hardness, nor on its ductility. The fibrous structure in the Transverse Short direction seems to favour resistance to sand abrasion. For this property of use, the superiority of the product originating from the process according to the present invention keeps to the combination between a particular fibrous structure, inaccessible with known processes, and the level of mechanical characteristics imparted by its composition. The applicant has found that resistance to sand abrasion of the product capable of being obtained by the process according to the present invention, expressed in the form of loss of mass during an assay described in Example 10 hereinbelow, if less than 0.20 g, and preferably less than 0.19 g for a plane exposed surface measuring 15×10 mm.

The product according to the invention has good damage tolerance properties. It can be used as a structural component in aeronautical construction. In a preferred embodiment of the invention, the product shows a level stress toughness $K_R$ in the T-L direction, measured according to ASTM standard E561 on CCT test pieces of width w=760 mm and initial crack length $2a_0$=253 mm, of at least 165 MPa√m for a $\Delta a_{eff}$ of 60 mm, and preferably of at least 175 MPa√m. Its fatigue crack propagation strength is comparable to that of sheets currently used as fuselage facing.

The product according to the invention, and particularly that belonging to the limited composition range defined by Zn 4.0-6.0%, Mg 0.7-1.5%, Mn<0.60%, is thus likely to be used as a structural component that must meet particular damage tolerance requirements (toughness, fatigue crack propagation strength). In this case, "structure element" or "structural element" of mechanical construction designates a mechanical piece whereof the failure is likely to endanger the safety of said construction, of its users or others. For an aircraft, these structural elements comprise especially the elements making up the fuselage (such as the fuselage skin), fuselage stiffeners or stringers, bulkheads, fuselage circumferential frames, wings (such as wing skin, stringers or stiffeners, ribs and spars) and tail plane, as well as floor beams, seat tracks and doors. Quite evidently, the present invention concerns only the structural elements which can be made from laminated sheet. More particularly, the product according to the invention is likely to be used as fuselage facing, in a conventional assembly (particularly riveted) or in a welded assembly.

The process according to the present invention thus produces a novel product having an advantageous combination of properties, such as mechanical resistance, damage tolerance, weldability, resistance to exfoliating corrosion and to stress corrosion, resistance to abrasion, which is particularly suitable to be used as a structural element in mechanical construction. In particular, it is suitable to utilisation in industrial vehicles, as well as in equipment for storage, transport or materials handling of granulous products, such as buckets, tanks or conveyors.

In addition, the process according to the present invention is particularly simple and fast; its operating cost is lower than that of processes according to the prior art resulting in products having comparable properties of use.

The invention will be better understood from the examples, which are not however in any way restrictive. Examples 1 and 2 belong to the prior art. Examples 3, 4, 8 and 9 correspond to the invention. Each of the examples 5, 6, 7, 9 and 10 compares the invention to the prior art.

EXAMPLES

Example 1

This example corresponds to a transformation range as in the prior art. It was generated by the semi-continuous casting of two plates A and B. Their composition is given in Table 2. Chemical analysis of the elements was carried out by X-ray fluorescence (for elements Zn and Mg) and spark spectroscopy (other elements) on a slug obtained from liquid metal taken from the main runner.

The rolling plates were reheated for 22 hours at 530° C. and hot-rolled as soon as they had reached, when leaving the kiln, a temperature of 515° C. The hot-rolled strips were coiled at 6 mm thickness, the process being conducted in such a way that the temperature, measured on the lips of the coil after being fully wound (at half-thickness of winding) is between 265° C. and 275° C., this value being the average between two measurements made at the two edges of the coil. After hot-rolling, the coils were split into sheets and part of the sheets obtained was cold-rolled to a thickness of 4 mm.

TABLE 2

| Alloy | Mg | Zn | Mn | Si | Fe | Cu | Zr | Ti | Cr |
|---|---|---|---|---|---|---|---|---|---|
| A | 1.20 | 4.48 | 0.12 | 0.12 | 0.21 | 0.10 | 0.12 | 0.036 | 0.25 |
| B | 1.15 | 4.95 | 0.006 | 0.04 | 0.10 | 0.13 | 0.11 | 0.011 | 0.05 |

After rolling, all the sheets were solution treated in a draught furnace for 40 minutes at temperatures between 460° C. and 560° C., water quenched and stretched by about 2%. A part of the products obtained in this way was characterised as such, in the T4 state, which corresponds to the Heat-Affected Zone T of the welds. The other part was subjected to an ageing treatment T6 including a 4-hour point at 100° C. followed by a 24-hour point at 140° C.

T4 state products have been solely characterised as layer corrosion (EXCO and SWAAT tests) since it is known (see particularly the article "The stress corrosion susceptibility of aluminium alloy 7020 welded sheets" by M. C. Reboul, B. Dubost and M. Lashermes, which appeared in the review Corrosion Science, vol 25, no 11, pp. 999-1018, 1985) that this is the state most sensitive to layer corrosion for Al—Zn—Mg alloys. On products in the T6 state, the yield strength was measured in the Transverse-Long direction and the layer corrosion strength (loss of mass after SWAAT test on a full thickness test piece or on a test piece machined to the core over half its surface) was assessed. Sensitivity to stress corrosion was determined in both directions, solely in the T6 state since it is known (see the article by Reboul et al. cited above) that this is the state most sensitive to stress corrosion. The results are given in Tables 3 and 4. The first letter of the sheet ID denotes the composition, the second the rolling range (C=hot to 6 mm, F=hot+cold to 4 mm) and the last the solution treatment temperature (B=low at 500° C., H=high at 560° C.).

TABLE 3

| Sheet ID | Thickness [mm] | Solution Treatment | $R_{p0.2\,(TL)}$ T6 State [MPa] | SWAAT Test Half machined [Δm in g/dm²] T4 | SWAAT Test Half machined [Δm in g/dm²] T6 | SWAAT Test Full thickness [Δm in g/dm²] T4 | SWAAT Test Full thickness [Δm in g/dm²] T6 |
|---|---|---|---|---|---|---|---|
| ACB | 6 mm | 500° C. | 359 | 1.15 | 1.08 | 1.44 | 0.52 |
| ACH | | 560° C. | 362 | 0.80 | 0.76 | 1.24 | 0.56 |
| AFB | 4 mm | 500° C. | 362 | Not characterised | | 1.14 | 0.30 |
| AFH | | 560° C. | 362 | | | 1.10 | 0.58 |
| BCB | 6 mm | 500° C. | 362 | 0.65 | 0.68 | 1.10 | 0.36 |
| BCH | | 560° C. | 375 | 0.47 | 0.48 | 0.66 | 0.30 |
| BFB | 4 mm | 500° C. | 362 | Not characterised | | 0.74 | 0.32 |
| BFH | | 560° C. | 365 | | | 0.52 | 0.32 |

It can be seen that sensitivity to layer corrosion is smaller for the alloy according to composition B (for an identical generation process and test conditions). This sensitivity is much more pronounced in the T4 state than in the T6 state. It reduces when the solution treatment temperature increases or when the alloy undergoes a cold-rolling step.

TABLE 4

| Sheet | Thickness [mm] | Solution Treatment | Direction of solicitation | A % Lab Air | A % Sea Water | A % Pre-Expo | I = CSC Index |
|---|---|---|---|---|---|---|---|
| ACB | 6 mm | 500° C. | Long | 16.2 | 14.9 | 15.8 | 5.5% |
| | | | Transverse | 15.1 | 14.7 | 15.1 | 2.6% |
| ACH | | 560° C. | Long | 16.7 | 15.1 | 16.3 | 7.2% |
| | | | Transverse | 14.7 | 13.4 | 14.5 | 7.5% |
| AFB | 4 mm | 500° C. | Long | 17.0 | 15.3 | 16.1 | 4.7% |
| AFH | | 560° C. | Long | 16.2 | 15.5 | 16.4 | 5.5% |
| BCB | 6 mm | 500° C. | Long | 16.1 | 14.2 | 16.1 | 11.8% |
| | | | Transverse | 17.0 | 15.6 | 16.8 | 7.0% |
| BCH | | 560° C. | Long | 15.2 | 13.1 | 15.1 | 13.1% |
| | | | Transverse | 16.0 | 12.8 | 16.0 | 20.0% |
| BFB | 4 mm | 500° C. | Long | 15.2 | 13.7 | 15.3 | 10.5% |
| BFH | | 560° C. | Long | 15.2 | 12.2 | 15.2 | 19.7% |

It can be seen that sensitivity to stress corrosion (CSC) is higher for the alloy according to composition B. This sensitivity increases with the solution treatment temperature.

Example 2

The sheets emanating from example 1, rolled to 6 mm and solution treated at 560° C., denoted ACH and BCH, were welded in the T6 state. Welding was done in the Transverse-Long direction, with a double Vee groove, by a semi-automatic smooth current MIG process, with a 5183 alloy welding wire (Mg 4.81%, Mn 0.651%, Ti 0.120%, Si 0.035%, Fe 0.130%, Zn 0.001%, Cu 0.001%, Cr 0.075%) of 1.2 mm diameter, supplied by the company Soudure Autogène Fran¢aise.

The tensile test pieces (width 25 mm, symmetrically shaved bead, effective length of test piece and length of extensometer equal to (W+2 e) where W denotes the width of the bead and e the thickness of the test piece) were taken in the long direction, perpendicularly to the weld, in such a way that the joint is located in the middle. Characterisation was carried out 19, 31 and 90 days after welding, since the man skilled in the art knows that for this type of alloy, the mechanical properties after welding increase strongly during the first weeks of ageing. Test pieces machined to half-thickness over half their surface were also subjected to SWAAT and EXCO tests. The results are given in Tables 5 (for the properties on the base metal in the T6 state) and 6 (properties on the welded metal).

TABLE 5

| Sheet | $R_{p0.2(L)}$ [MPa] | $R_{m(L)}$ [MPa] | $A\%_{(L)}$ [%] | Loss of mass Δm [g/dm²] SWAAT 100 cycles | Loss of mass Δm [g/dm²] EXCO 96 h | Dimensioning of layer corrosion SWAAT 100 cycles | Dimensioning of layer corrosion EXCO 96 h |
|---|---|---|---|---|---|---|---|
| ACH | 351 | 378 | 17 | 0.76 | 4.68 | EA | EA |
| BCH | 351 | 376 | 16.9 | 0.48 | 3.25 | Pc | Pc |

TABLE 6

| Sheet | $R_{p0.2}$ [MPa] 19 days after welding | $R_m$ [MPa] 19 days after welding | $R_{p0.2}$ [MPa] 31 days after welding | $R_m$ [MPa] 31 days after welding | $R_{p0.2}$ [MPa] 90 days after welding | $R_m$ [MPa] 90 days after welding | Dimensioning of the welded zone SWAAT 100 cycles | Dimensioning of the welded zone EXCO 96 h |
|---|---|---|---|---|---|---|---|---|
| ACH | 216 | 346 | 219 | 354 | 236 | 358 | EB | EB |
| BCH | 194 | 321 | 197 | 325 | 218 | 328 | EB | EB |

It may be observed that the alloy according to composition B has mechanical properties after welding that are less advantageous than the alloy according to composition A. After welding, the layer corrosion strength of the two alloys is degraded relative to the behaviour of the base metal.

Example 3

This example corresponds to the present invention. By semi-continuous casting a plate C was generated. Its composition is identical to that of the plate B emanating from example 1. The plate was hot-rolled, after reheating for 13 hours at 550° C. (point duration) followed by a rolling point at 540° C. The first step, in the reversing mill, brought the plate to a thickness of 15.5 mm, the output temperature of the rolling mill being about 490° C. The rolled plate was then cooled by spraying and by natural convection to a temperature of about 260° C. At this temperature it was put into a tandem mill (3 cages), rolled to the final thickness of 6 mm, and coiled. The winding temperature of the coil, measured as in example 1, is about 150° C. Once naturally cooled, the coil was cut up into sheets. These were levelled and were subjected to no further operation of distortion.

As in examples 1 and 2, the sheets obtained (identified as "C") were characterised in unwrought manufacture (Long and Transverse-Long direction static mechanical characteristics, layer and stress corrosion) and after welding (static mechanical characteristics, layer corrosion). Welding was carried out simultaneously to the welding in example 2, and according to the same method. Test pieces machined to half-thickness over half their surface were subjected to SWAAT and EXCO tests. The results are collected in Tables 7 and 8 (unwelded sheets) and in Table 9 (welded sheets).

TABLE 7

| | | | | Loss of mass Δm en g/dm$^2$ | | Dimensioning of layer corrosion | |
|---|---|---|---|---|---|---|---|
| | | | | SWAAT | | | |
| Sheet ID | $R_{p0.2}$ [MPa] | $R_m$ [MPa] | A % [%] | 100 cycles | EXCO 96 h | SWAAT 100 cycles | EXCO 96 h |
| C | $305_{(L)}$ $330_{(TL)}$ | $344_{(L)}$ $356_{(TL)}$ | $14.4_{(L)}$ $13.3_{(TL)}$ | 0.85 | 5.1 | EA | EA/EB |

TABLE 8

| Sheet ID | Thickness [mm] | Direction Of solicitation | A % Lab Air | A % Sea Water | A % Pre-Expo | I = CSC Index |
|---|---|---|---|---|---|---|
| C | 6 mm | Transverse | 13.1 | 10.8 | 13.5 | 20% |

TABLE 9

| | $R_{p0.2}$ | $R_m$ | $R_{p0.2}$ | $R_m$ | $R_{p0.2}$ | $R_m$ | Dimensioning of the welded zone | |
|---|---|---|---|---|---|---|---|---|
| | [MPa] | [MPa] | [MPa] | [MPa] | 8 MPa] | [MPa] | SWAAT | |
| Sheet | 19 days after welding | | 31 days after welding | | 90 days after welding | | 100 cycles | EXCO 96 h |
| C | 223 | 338 | 235 | 338 | 245 | 340 | EB | EB |

The unwrought (unwelded) sheet according to the invention has a layer corrosion strength below that of the BCH sheet, manufactured from the same composition but with a much more complex manufacturing process. On the other hand, its stress corrosion strength is equivalent.

After welding, the sheet according to the invention has a mechanical resistance that is very clearly greater than that of the ACH and BCH sheets generated with a prior art process. Its layer corrosion strength on the welded joint is equivalent.

It may be observed that the process according to the invention coils at a temperature of about 120° C. less than the prior art process in example 1.

Example 4

Figure 5:
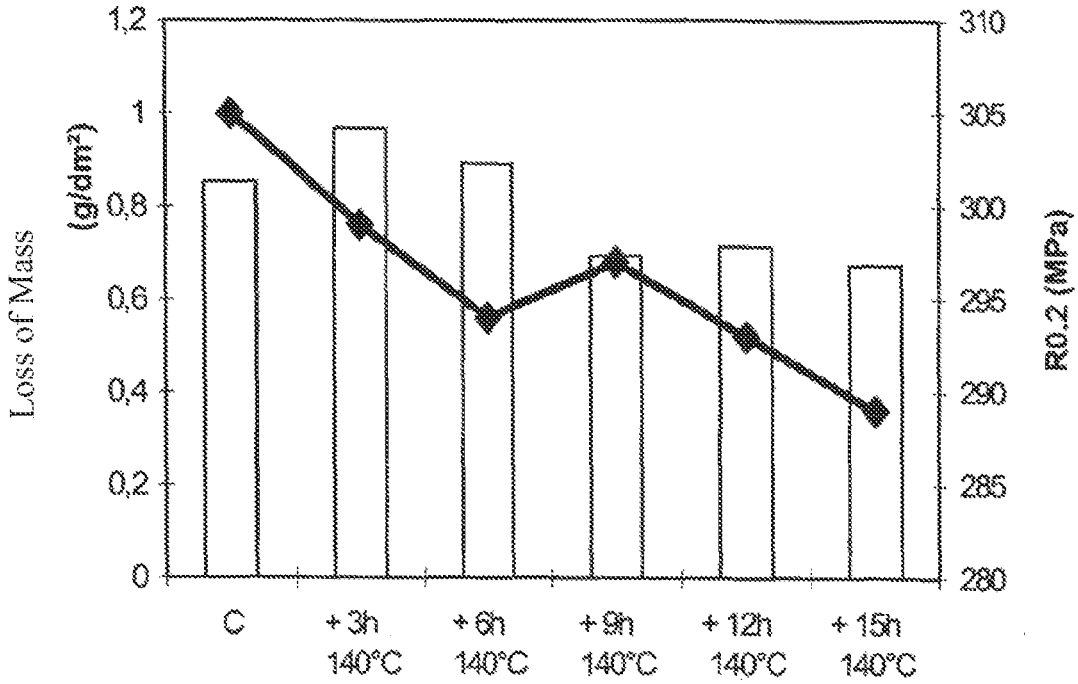
FIG. 5 compares the yield strength in the direction L (black dots connected by the black curve) and the loss of mass during a layer corrosion test (bars) for an intermediate product according to the invention and five different heat treatments of said intermediate product.

The sheet identified as "C" emanating from example 3 was subjected to additional heat treatments of the ageing type at a temperature of 140° C. The samples thus obtained were then characterised as in example 3 (L direction static mechanical characteristics and layer corrosion). The results are collected in Table 10 and in FIG. 5 (the black dots and the black line correspond to the yield strength and the bars to the loss of mass during the SWAAT test).

TABLE 10

| Heat Treatment | $R_{p0.2(L)}$ [MPa] | $R_{m(L)}$ [MPa] | $A\%_{(L)}$ [%] | Loss of mass Δm in g/dm² SWAAT 100 cycles | Loss of mass Δm in g/dm² EXCO 96 h | Dimensioning of layer corrosion SWAAT 100 cycles |
|---|---|---|---|---|---|---|
| None ("C") | 305 | 344 | 14.4 | 0.85 | 5.1 | EA |
| 3 h 140° C. | 299 | 336 | 15.1 | 0.97 | 5.0 | EA |
| 6 h 140° C. | 294 | 332 | 15.3 | 0.89 | 5.2 | Pc/EA |
| 9 h 140° C. | 297 | 335 | 15.3 | 0.69 | 4.0 | Pc/EA |
| 12 h 140° C. | 293 | 332 | 15.3 | 0.71 | 4.1 | Pc/EA |
| 15 h 140° C. | 289 | 330 | 15.5 | 0.67 | 3.8 | Pc |

This result shows that the layer corrosion behaviour of the product according to the invention can be very substantially improved by a simple additional ageing treatment or else by a slightly higher coiling temperature, and this probably without degrading the mechanical properties after welding.

Example 5

The microstructure of the ACH, BCH, BFH and C samples in examples 1, 2 and 3 was characterised by field emission gun scanning electron microscopy (FEG-SEM, in BSE (backscattered electrons) mode, acceleration voltage 15 kV, diaphragm 30 μm, working distance 10 mm, carried out on a polished cross-section in the L-TS sampling direction with conductive deposition Pt/Pd) and by transmission electron microscopy (TEM, L-TL sampling direction, slide preparation by twin jet electrochemical thinning with 30% $HNO_3$ in methanol at −35° C. with a potential of 20 V). All the samples were taken at half-thickness of the sheet.

Major differences can be observed between the ACH, BCH and BFH samples on the one hand, and the C sample on the other hand:

- The width of the precipitation-free zone (PFZ) at the grain boundaries is about 25 to 35 nm in the ACH, BCH and BFH samples, whereas it is about 120 to 140 nm in the C sample.
- Precipitations of the $MgZn_2$ type at the grain boundaries have an average size of about 30 to 60 nm in the ACH, BCH and BFH samples, whereas they have an average size of between 200 and 400 nm in the C sample.

Example 6

Figure 6:
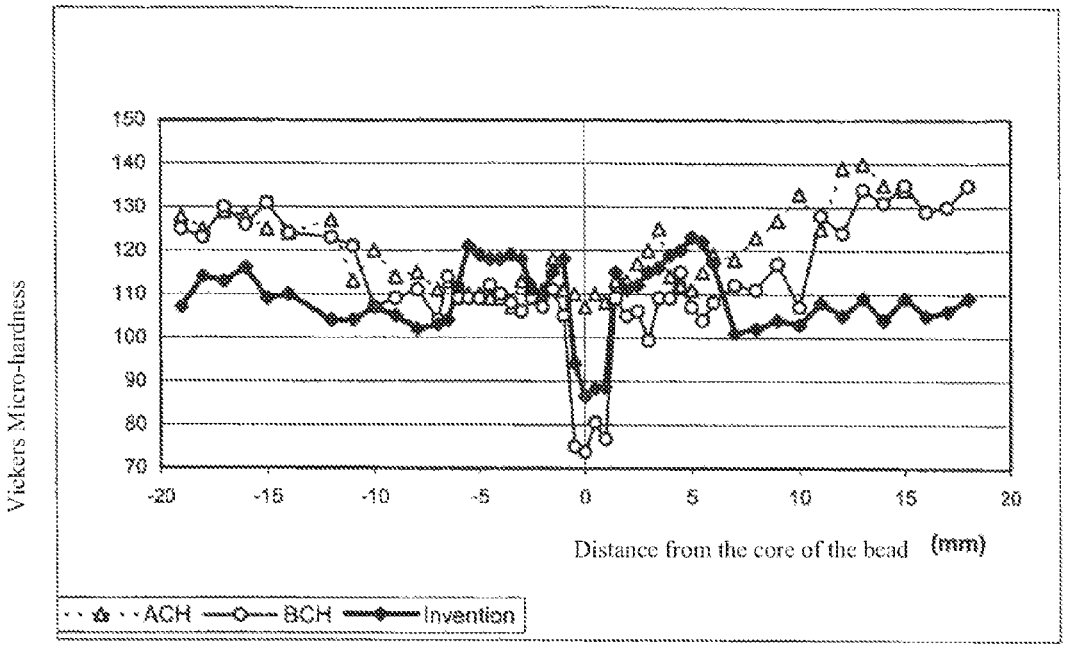
FIG. 6 compares the Vickers micro-hardness in the welded zone for three different welded samples.

An ACH sheet, a BCH sheet (generated as described in example 1) and a sheet C (generated according to the invention as described in example 3) were welded in the TL (Transverse-Long) direction as described in examples 2 and 3. On a polished cross-section across the welded joint (TS-L plane), the micro-hardness of the joint was then determined by a series of measurements taken on a straight line perpendicular to the joint. The values shown in Table 11 and FIG. 6 were found. The Dist parameter [mm] shows the distance of the measurement point relative to the core of the welding bead. The hardness values are given in Hv (Vickers Hardness).

TABLE 11

| | Dist −19 | −18 | −17 | −16 | −15 | −14 | −12 | −11 | −10 | −9 | −8 | −7 | −6.5 |
|---|---|---|---|---|---|---|---|---|---|---|---|---|---|
| ACH | 128 | 125 | 129 | 128 | 125 | 124 | 127 | 113 | 120 | 114 | 115 | 111 | 113 |
| BCH | 125 | 123 | 130 | 126 | 131 | 124 | 123 | 121 | 107 | 109 | 111 | 104 | 114 |
| C | 107 | 114 | 113 | 116 | 109 | 110 | 104 | 104 | 107 | 105 | 102 | 103 | 104 |

| | Dist −6 | −5.5 | −5 | −4.5 | −4 | −3.5 | −3 | −2.5 | −2 | −1.5 | −1 | −0.5 | 0 |
|---|---|---|---|---|---|---|---|---|---|---|---|---|---|
| ACH | 112 | 110 | 110 | 109 | 109 | 107 | 113 | 112 | 111 | 118 | 111 | 110 | 107 |
| BCH | 109 | 109 | 109 | 112 | 110 | 108 | 106 | 109 | 107 | 111 | 105 | 75 | 74 |
| C | 112 | 121 | 119 | 118 | 118 | 119 | 118 | 111 | 110 | 115 | 118 | 94 | 87 |

TABLE 11-continued

| | Dist | | | | | | | | | | | | |
|---|---|---|---|---|---|---|---|---|---|---|---|---|---|
| | 0.5 | 1 | 1.5 | 2 | 2.5 | 3 | 3.5 | 4 | 4.5 | 5 | 5.5 | 6 | 7 |
| ACH | 110 | 108 | 113 | 113 | 117 | 120 | 125 | 114 | 112 | 111 | 115 | 119 | 118 |
| BCH | 81 | 77 | 109 | 105 | 106 | 99 | 109 | 109 | 115 | 107 | 104 | 108 | 112 |
| C | 88 | 89 | 115 | 111 | 112 | 115 | 116 | 119 | 120 | 123 | 122 | 117 | 101 |

| | Dist | | | | | | | | | | |
|---|---|---|---|---|---|---|---|---|---|---|---|
| | 8 | 9 | 10 | 11 | 12 | 13 | 14 | 15 | 16 | 17 | 18 |
| ACH | 123 | 127 | 133 | 125 | 139 | 140 | 135 | 134 | | | |
| BCH | 111 | 117 | 107 | 128 | 124 | 134 | 131 | 135 | 129 | 130 | 135 |
| C | 102 | 104 | 103 | 108 | 105 | 109 | 104 | 109 | 105 | 106 | 109 |

The base sheet manufacturing process can be seen to influence the characteristics of the welded joint obtained with this base sheet: a welded joint generated with a C sheet, manufactured by the process according to the invention, shows obviously greater hardness in the heat-affected zone (HAZ) of the weld joint (Dist=[−5.5, −1.5] and [+1.5, +5.5]) than a welded joint generated with a BCH sheet, of the same composition but manufactured according to prior art process. Furthermore, the heat-affected zone is of greater hardness than the base metal for the C sheet manufactured by the process according to the invention, which is quite unusual.

Example 7

6056 alloy sheets were prepared plated on both surfaces with the 1300 alloy, according to the process described in example 3 of patent application EP 1 170 118 A1. The chemical composition of the 6056 core is given in Table 12. These products are compared with the C sheet in example 3 of the present patent application.

Figure 7:
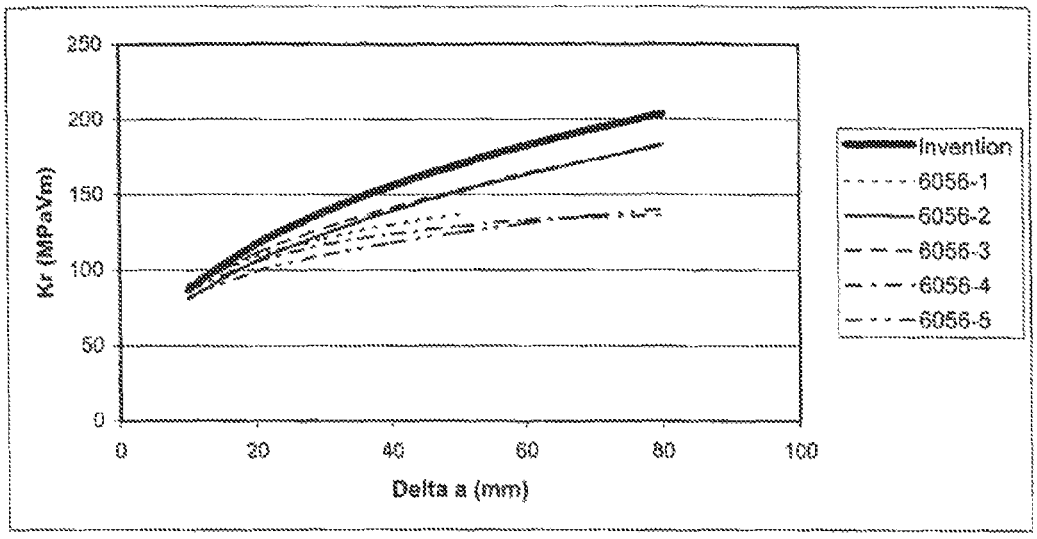
FIG. 7 compares the tear strength Kr as a function of the crack extension ("delta a", which signifies Δ a) for six different sheets.

The level stress toughness in the T-L direction was determined in accordance with ASTM standard E561 on CCT test pieces of width w=760 mm and initial crack length $2a_0$=253 mm. The thickness of the test pieces is given in Table 12. The test allows the curve R of the material to be defined, giving the tear strength $K_R$ as a function of the crack extension Δa. The results are collected in Table 13 and in FIG. 7.

Figure 8:
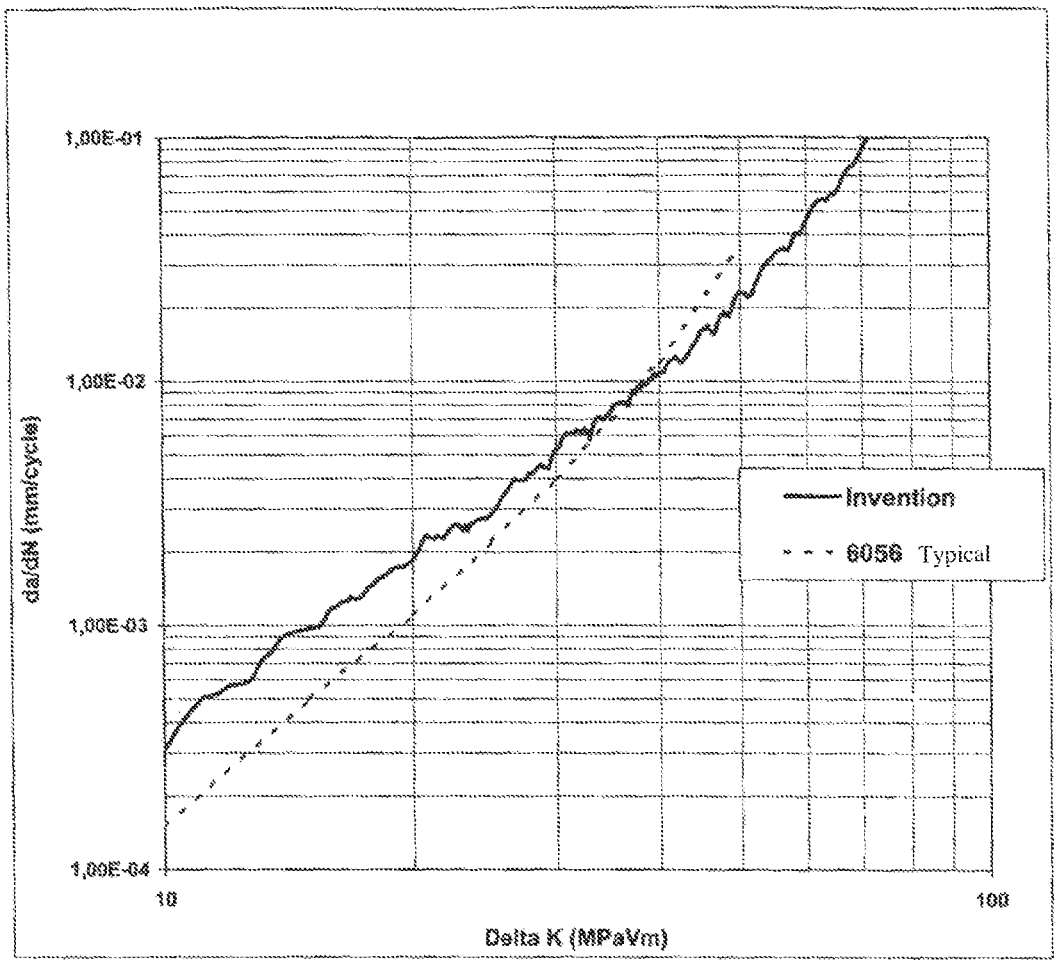
FIG. 8 compares the crack propagation rate da/dn of a sheet according to the invention with a sheet according to the prior art.

The crack propagation rate da/dn was also determined in accordance with ASTM standard E 647 in the T-L direction for R=0.1 on a CCT test piece of width w=400 mm with an initial crack length 2a0=4 mm, at a frequency f=3 Hz. The test pieces were cut out of the full thickness of the sheets. The results are collected in FIG. 8.

TABLE 12

| Sheet | Fe [%] | Si [%] | Cu [%] | Mn [%] | Thickness plated sheet [mm] | Thickness test piece curve R [mm] |
|---|---|---|---|---|---|---|
| 6056-1 | 0.14 | 1.01 | 0.61 | 0.55 | 4.5 | 4.5 |
| 6056-2 | 0.07 | 0.83 | 0.66 | 0.60 | 3.2 | 3.2 |
| 6056-3 | 0.07 | 0.83 | 0.66 | 0.60 | 3.2 | 3.2 |
| 6056-4 | 0.12 | 0.85 | 0.67 | 0.59 | 7 | 5.5 (*) |
| 6056-5 | 0.12 | 0.85 | 0.67 | 0.59 | 7 | 5.5 (*) |

NOTE:
Zr content 0.1% and Mg content 0.7% for all five sheets.
(*) Obtained by symmetrical machining

TABLE 13

| | | sheet | | | | |
|---|---|---|---|---|---|---|
| | C | 6056-1 | 6056-2 | 6056-3 | 6056-4 | 6056-5 |
| $a_{eff}$ [mm] | | Level stress toughness $K_R$ [MPa√m] | | | | |
| 10 | 87 | 90 | 81 | 88 | 86 | 82 |
| 20 | 117 | 109 | 106 | 111 | 105 | 99 |
| 30 | 138 | 121 | 124 | 128 | 117 | 110 |
| 40 | 156 | 130 | 139 | 141 | 124 | 118 |
| 50 | 170 | 137 | 152 | 153 | 129 | 125 |
| 60 | 182 | | 163 | 164 | 133 | 131 |
| 70 | 193 | | 173 | 173 | 135 | 136 |
| 80 | 203 | | 183 | 182 | 136 | 140 |

It may be observed that the product according to the invention shows better level stress toughness $K_R$ than a known reference product, whereas the crack propagation rate da/dN (T−L) at high ΔK values is substantially comparable.

Example 8

An alloy whereof the composition is indicated in Table 14 is processed according to the process of the present invention.

TABLE 14

| Alloy | Mg | Zn | Mn | Si | Fe | Cu | Zr | Ti | Cr |
|---|---|---|---|---|---|---|---|---|---|
| S | 1.23 | 5.00 | 0.01 | 0.03 | 0.09 | 0.01 | 0.14 | 0.03 | 0.002 |

The essential parameters of the process, here S1, were:

$T_1$=550° C., $T_2$=520° C., $T_4$=267° C., $T_5$=267° C., $T_6$=210° C.

The temperature $T_S$ was 603° C. (value obtained by numerical calculation). The final thickness of the strip was 6 mm, and its width was 2400 mm.

It is observed that the final product shows no recrystallisation. In the L/TC plane, a fibrous microstructure is observed at mid thickness, with a thickness of grains of the order of 10 μm.

Representative sheets, shared out over the full width at half thickness of winding of the coil, at mid-width showed the mechanical characteristics indicated in Table 15:

TABLE 15

| $R_{P0.2(L)}$ [Mpa] | $R_{m(L)}$ [MPa] | A $\%_{(L)}$ [%] | $R_{P0.2(TL)}$ [MPa] | $R_{m(TL)}$ [MPa] | A $\%_{(TL)}$ [%] |
|---|---|---|---|---|---|
| 275 | 236 | 15.9 | 279 | 249 | 16.4 |

Resistance to corrosion, evaluated by the EXCO test, was EA on the surface and at mid-thickness. Resistance to corrosion, evaluated by the SWAAT test, was P at the surface and at mid-thickness, and the loss of mass was 0.52 g/dm$^2$ on the surface and 0.17 g/dm$^2$ at mid-thickness.

Example 9

An alloy whereof the composition is indicated in Table 16 is processed according to the process of the present invention.

TABLE 16

| Alloy | Mg | Zn | Mn | Si | Fe | Cu | Zr | Ti | Cr |
|---|---|---|---|---|---|---|---|---|---|
| U | 1.23 | 5.07 | 0.19 | 0.05 | 0.12 | 0.07 | 0.10 | 0.03 | 0.002 |

Four coils (width 2415 mm) were prepared under different transformation conditions. In addition, a coil of composition S (here called S2) according to the assembly 8 was transformed (width 1500 mm).

The essential parameters of the process were (all temperatures in ° C.):

TABLE 17

| coil | $T_1$ | $T_2$ | $T_3$ | $T_4$ | $T_5$ | $T_6$ |
|---|---|---|---|---|---|---|
| U1 | 550 | 528 | 435 | 277 | 277 | 240 |
| U2 | 550 | 508 | 445 | 256 | 256 | 220 |
| U3 | 550 | 517 | 405 | 289 | 289 | 200 |
| U4 | 550 | 499 | 430 | 264 | 264 | 200 |
| S2 | 550 | 535 | 460 | 272 | 272 | 155 |

The temperature $T_S$ for the alloy U was 600° C. (value obtained by numerical calculation). The thickness of the strips U3 and U4 was 6 mm, that of the strips U1, U2 and S2 was 8 mm.

Representative sheets, shared out over the full width at half thickness of winding of the coil, showed at mid-width the mechanical characteristics indicated in Table 18:

TABLE 18

| coil | $R_{p0.2\ (L)}$ [MPa] | $R_{m\ (L)}$ [MPa] | A $\%_{(L)}$ [%] |
|---|---|---|---|
| U1 | 298 | 265 | 13.5 |
| U2 | 358 | 335 | 11.4 |
| U3 | 317 | 294 | 13.2 |
| U4 | 352 | 334 | 13.4 |
| S2 | 332 | 307 | 11.9 |

Example 10

A comparison was made of the microstructure and the resistance to abrasion of different sheets obtained by the process according to the present invention (reference 7108 F7) and according to the prior art (references 5086H24, 5186H24, 5383H34, 7020 T6, 7075 T6 and 7108 T6). Table 19 lists the results relating to the mechanical characteristics and the microstructure of these sheets.

TABLE 19

| Reference | $R_{p0.2(L)}$ [MPa] | $R_{m(L)}$ [Mpa] | A $\%_{(L)}$ [%] | Hardness {HV) | Average length of grain [μm] TS | L | TL |
|---|---|---|---|---|---|---|---|
| 5086 H24 | 254 | 327 | 17 | 92~ | 10 | 300 | 150 |
| 5186 H24 | 270 | 335 | 17 | 94 | 19 | 200 | 110 |
| 5383 H34 | 279 | 374 | 18 | 105 | 8 | 190 | 165 |
| 7020 T6 | 335 | 371 | 15 | 132 | 33 | 200 | 220 |
| 7075 T6 | 541 | 607 | 11 | 191 | 24 | 220 | 155 |
| 7108 T6 | 360 | 395 | 17.5 | 125 | 100 | 390 | 320 |
| 7108 F7 | 305 | 344 | 14.5 | 112 | 8 | 500 | 290 |

The material 7108 T6 had the composition of the alloy B of Example 2, and was close to the material BCH. The material 7108 F7 has the same composition B as in Example 2.

Abrasion resistance was characterised by means of an original device which reproduces conditions such as they can be presented for example during loading, transport and unloading of sand in a bucket. This test consists of A measuring the loss of mass of a sample subjected to a vertical up-and-down movement in a tank filled with sand. The diameter of the tank is around 30 cm, the height of the sand around 30 cm. The sample carrier is fixed to a vertical rod attached to a double-action jack ensuring the vertical up-and-down movement of the rod. The sample carrier is in the form of a pyramid with an angle of 45°. It is the point of the pyramid which plunges into the sand. The samples to be tested, measuring 15×10×5 mm, are embedded in the faces of the pyramid such that their surface is tangential to that of the corresponding face of the pyramid; it is the face corresponding to the plane L-TL (dimension 15×10 mm) which is exposed to the sand. The depth of penetration of the sample in the sand was 200 mm.

The same operating mode was used for all the samples. It implies degreasing with acetone of the sample, filling the tank with the same quantity of the same standard sand (sand according to NF EN 196-1), stopping the machine every 1000 cycles and replacement of the worn sand by new sand, weighing the samples every 2000 cycles (after a cleaning process with acetone and compressed air), stopping the test after 10000 cycles. The results are collected in Table 20:

TABLE 20

| Reference | Face tested | Loss of mass [g] at 10 000 cycles |
|---|---|---|
| 5086 H24 | Raw | 0.198 |
| 5186 H24 | Raw | 0.233 |
| 5383 H34 | Raw | 0.193 |
| 7020 T6 | Raw | 0.252 |
| 7075 T6 | Raw | 0.225 |
| 7108 T6 | Machined | 0.199 |
| 7108 F7 | machined | 0.175 |

The values of loss of mass indicated are the average of all three tests; the interval de confidence is of the order of ±0.01 to 0.02 g; this underlines the good repeatability of this test.

Table 19 shows the highly particular microstructure of the product obtained by the process according to the present invention, by comparing the two alloy products 7108, with one (reference T6) obtained according to the prior art, the other (reference F7) according to the process which is the object of the present invention. Table 20 shows the effect of this microstructure on abrasion resistance. It is immediately evident that the product according to the present invention better resists abrasion than the standard product 5086H24. This emphasises its good aptitude to use in industrial vehicles, as well as in equipment for storage and handling granular products, such as buckets, tanks, or conveyors.

The invention claimed is:

1. A process for generating an intermediate laminated product in an aluminum alloy of the Al—Zn—Mg type, said process consisting of:

a) generating a plate by semi-continuous casting, the plate containing (in percentages per unit mass):

Mg 0.5-2.0, Mn<1.0, Zn 3.0-9.0, Si<0.50, Fe<0.50, Cu<0.50, Ti<0.15, Zr<0.20 the remainder aluminum with inevitable impurities, in which Zn/Mn>1.7;

b) subjecting said plate to homogenization or reheating to a temperature $T_1$, selected so that 500° C.≦$T_1$≦($T_s$−20° C.), where $T_s$ is the alloy burning temperature;

c) conducting an initial hot-rolling step including one or more roll runs on a hot rolling mill, an input temperature $T_2$ of the initial hot rolling step being selected such that ($T_1$−60° C.)≦$T_2$≦($T_1$−5° C.), and the rolling process being conducted in such a way that the output temperature $T_3$ in such that ($T_1$−150° C.)≦$T_3$≦($T_1$−30° C.) and $T_3$≦$T_2$;

d) cooling a strip emerging from said initial hot-rolling step to a temperature $T_4$;

e) conducting a second hot-rolling step on said strip at an input temperature $T_5$, the input temperature $T_5$ being selected such that $T_5$≦$T_4$ and 200° C.≦$T_5$≦300° C., and the second hot-rolling process being conducted in such a way that the coiling temperature T6 is such that ($T_5$−150° C.)≦$T_6$≦($T_5$−20° C.);

f) optionally conducting at least a cold-rolling, aging treatment, and/or cutting operation;

wherein the yield strength Rp0.2 of said laminated product is at least 250 MPa, the fracture strength Rm of said laminated product is at least 280 MPa, and the elongation at fracture of said laminated product is at least 8%.

2. A process according to claim 1, wherein the zinc content of the alloy is between from 4.0 to 6.0%, the Mg content is from 0.7 to 1.5%, and the Mn content is less than 0.60%.

3. A process according to claim 2, wherein Cu<0.25%.

4. A process according to claim 2, wherein the alloy is selected from the group consisting of alloys 7020, 7108, 7003, 7004, 7005, 7008, 7011, and 7022.

5. A process according to claim 1, wherein said intermediate laminated product has a thickness from 3 mm to 12 mm.

6. A process according to claim 1, wherein said intermediate laminated product is subjected to cold working reduction from 1% to 9%, and/or to an additional heat treatment including one or more points at temperatures between from 80° C. to 250° C., said additional heat treatment being able to occur before, after or during said cold working.

7. A process according to claim 1, wherein the temperature $T_3$ is such that ($T_1$−100° C.)≦$T_3$≦($T_1$−30° C.) and/or the temperature $T_2$ is such that ($T_1$−30° C.)≦T2≦($T_1$−5° C.).

8. A process according to claim 1, wherein the temperature $T_3$ is greater than a solvus temperature of the alloy.

9. A process according to claim 1, wherein the alloy is a 7108 alloy and the temperatures $T_1$ to $T_6$ are respectively $T_1$=550° C., $T_2$=540° C., $T_3$=490° C., $T_4$=270° C., $T_5$=270° C., $T_6$=150° C.

10. A process according to claim 1, wherein heat treatment operations are carried out on-line, without any heat treatments being carried out separately.

11. A process according to claim 1, wherein each step of said process is conducted at a lower temperature than the temperature of a previous step.

12. A process of claim 1 wherein said yield strength $R_{p0.2}$ is at least 290 MPa and said fracture strength $R_m$ is at least 330 MPa.

13. A process of claim 1, wherein Zn: 4.0-6.0%, Mg 0.7-1.5%, Mn<0.60%, Cu<0.25% and wherein a width of the precipitation-free zones at grain boundaries thereof of said laminated product is at least 100 nm.

14. A process of claim 1, wherein Zn: 4.0-6.0%, Mg 0.7-1.5%, Mn<0.60%, Cu<0.25% and wherein $MgZn_2$ type precipitations at grain boundaries of said laminated product have an average size of at least 150 nm.

15. A process for generating an intermediate laminated product in an aluminum alloy of the Al—Zn—Mg type, said process consisting of:

a) generating a plate by semi-continuous casting, the plate containing (in percentages per unit mass):

Mg 0.5-2.0, Mn<1.0, Zn 3.0-9.0, Si<0.50, Fe<0.50, Cu<0.50, Ti<0.15, Zr<0.20, and at least one element selected from the group consisting of Sc, Y, La, Dy, Ho, Er, Tm, Lu, Hf, and Yb with a concentration not exceeding the following values:

Sc<0.50%,

Y<0.34%,

La, Dy, Ho, Er, Tm, Lu<0.10% each,

Hf<1.20%,

Yb<0.50%, the remainder aluminum with inevitable impurities, in which Zn/Mn>1.7;

b) subjecting said plate to homogenization or reheating to a temperature $T_1$, selected so that 500° C.≦$T_1$≦($T_s$≦20° C.), where $T_s$ is the alloy burning temperature;

c) conducting an initial hot-rolling step including one or more roll runs on a hot rolling mill, an input temperature $T_2$ of the initial hot rolling step being selected such that ($T_1$−60° C.)≦$T_2$≦($T_1$−5° C.), and the rolling process being conducted in such a way that the output temperature $T_3$ in such that ($T_1$−150° C.)≦$T_3$≦($T_1$−30° C.) and $T_3$≦$T_2$;

d) cooling a strip emerging from said initial hot-rolling step to a temperature $T_4$;

e) conducting a second hot-rolling step on said strip at an input temperature $T_5$, the input temperature $T_5$ being selected such that $T_5$≦$T_4$ and 200° C.≦$T_5$≦300° C., and the second hot-rolling process being conducted in such a way that the coiling temperature T6 is such that ($T_5$−150° C.)≦$T_6$≦($T_5$−20° C.);

f) optionally conducting at least a cold-rolling, aging treatment, and/or cutting operation;

wherein the yield strength Rp0.2 of said laminated product is at least 250 MPa, the fracture strength Rm of said laminated product is at least 280 MPa, and the elongation at fracture of said laminated product is at least 8%.

* * * * *